US011105515B2

(12) United States Patent
Lee et al.

(10) Patent No.: US 11,105,515 B2
(45) Date of Patent: Aug. 31, 2021

(54) COOKING APPARATUS

(71) Applicant: LG ELECTRONICS INC., Seoul (KR)

(72) Inventors: Yonghyun Lee, Seoul (KR); Kyoungjoon Park, Seoul (KR); Jaekyung Yang, Seoul (KR); Yongsoo Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 136 days.

(21) Appl. No.: 16/490,783

(22) PCT Filed: Feb. 20, 2018

(86) PCT No.: PCT/KR2018/002071
§ 371 (c)(1),
(2) Date: Sep. 3, 2019

(87) PCT Pub. No.: WO2018/159953
PCT Pub. Date: Sep. 7, 2018

(65) Prior Publication Data

US 2020/0018489 A1 Jan. 16, 2020

(30) Foreign Application Priority Data

Mar. 3, 2017 (KR) ..... 10-2017-0027523

(51) Int. Cl.
*F24C 15/16* (2006.01)
*F24C 15/02* (2006.01)

(52) U.S. Cl.
CPC ..... *F24C 15/16* (2013.01); *F24C 15/02* (2013.01)

(58) Field of Classification Search
CPC ..... F24C 15/16; F24C 15/168; A47B 77/12
See application file for complete search history.

(56) References Cited

U.S. PATENT DOCUMENTS 2,590,341 A * 3/1952 Nabholz ..... A47B 21/02 312/266
2,643,167 A * 6/1953 Wade ..... A47B 17/033 312/27

(Continued)

FOREIGN PATENT DOCUMENTS

JP H04-013010 1/1992
JP 2001-132821 5/2001

(Continued)

OTHER PUBLICATIONS

International Search Report (with English Translation) dated May 21, 2018 issued in Application No. PCT/KR2018/002071.

(Continued)

*Primary Examiner* — Jorge A Pereiro
(74) *Attorney, Agent, or Firm* — Ked & Associates LLP

(57) ABSTRACT

A cooking apparatus includes a case including an inner case having a cooking chamber formed therein and an outer case configured to surround the inner case, and having an open front surface, a tray put on the cooking chamber, a door coupled to the front surface of the case and configured to selectively open and close the open front surface, an elevating device installed at left and right internal surfaces of the inner case and configured to move the tray in forward and backward directions and upward and downward directions, wherein the elevating device includes a fixed rail fixed to an internal side surface of the inner case, a moveable rail configured to slide and move in forward and backward directions in a state where the moveable rail is coupled to the fixed rail, a support link configured to connect a side surface of the tray and the moveable rail, and a manipulator connected to the moveable rail and the support link.

17 Claims, 13 Drawing Sheets

(56) References Cited

U.S. PATENT DOCUMENTS

| | | | | |
|---|---|---|---|---|
| 2,744,805 | A * | 5/1956 | McMahan | A47B 77/12 312/27 |
| 2,822,229 | A * | 2/1958 | Carlson | A47B 77/12 312/27 |
| 2,919,966 | A * | 1/1960 | Preston | A47F 3/06 312/27 |
| 2,987,363 | A * | 6/1961 | Morse | F24C 15/022 312/274 |
| 5,447,146 | A * | 9/1995 | Nickerson | F24C 15/16 126/332 |
| 7,628,461 | B2 * | 12/2009 | Carden | F25D 25/025 312/310 |
| 8,303,053 | B2 * | 11/2012 | Bond | A47L 15/506 312/319.2 |
| 8,733,862 | B1 * | 5/2014 | Armstrong | F24C 15/16 312/319.3 |
| 9,022,496 | B2 * | 5/2015 | Armstrong | F24C 15/16 312/410 |
| 9,420,882 | B2 * | 8/2016 | Garcia | A47L 15/504 |
| 9,629,454 | B2 * | 4/2017 | Bunch | A47B 51/00 |
| 9,788,649 | B2 * | 10/2017 | Bunch | A47B 51/00 |
| 10,085,552 | B2 * | 10/2018 | Boguslawski | A47B 45/00 |
| 10,231,599 | B2 * | 3/2019 | Kulkarni | A47L 15/428 |
| 10,729,306 | B2 * | 8/2020 | Roos | A47L 15/50 |
| 2005/0073225 | A1 * | 4/2005 | Kwon | A47B 46/005 312/402 |
| 2005/0206282 | A1 * | 9/2005 | Walburn | A47B 46/005 312/312 |
| 2006/0066189 | A1 * | 3/2006 | Bond | A47B 88/90 312/319.1 |
| 2007/0035220 | A1 * | 2/2007 | Bond | A47L 15/506 312/319.1 |
| 2012/0074080 | A1 * | 3/2012 | Garcia | F24C 15/168 211/41.9 |
| 2014/0001425 | A1 * | 1/2014 | Falcon | A47B 77/12 254/133 R |
| 2015/0002005 | A1 * | 1/2015 | Park | A47L 15/507 312/228.1 |
| 2015/0377493 | A1 | 12/2015 | Kim et al. | |

FOREIGN PATENT DOCUMENTS

| | | |
|---|---|---|
| JP | 2006-057955 | 3/2006 |
| KR | 20-0209183 | 1/2001 |
| KR | 10-2015-0141797 | 12/2015 |
| KR | 10-2016-0000661 | 1/2016 |

OTHER PUBLICATIONS

Written Opinion dated May 21, 2018 issued in Application No. PCT/KR2018/002071.

* cited by examiner

COOKING APPARATUS

CROSS-REFERENCE TO RELATED PATENT APPLICATIONS

This application is a U.S. National Stage Application under 35 U.S.C. § 371 of PCT Application No. PCT/KR2018/002071, filed Feb. 20, 2018, which claims priority to Korean Patent Application No. 10-2017-0027523, filed Mar. 3, 2017, whose entire disclosures are hereby incorporated by reference.

TECHNICAL FIELD

The present invention relates to a cooking apparatus.

BACKGROUND ART

In general, a cooking apparatus is a home appliance for cooking foods and includes electric oven, a microwave, or the like.

In particular, the electric oven is a device that confines steam generated from food along with heat and heats and cooks the food at high temperature.

A conventional oven is configured in such a way that a user bends his or her body and puts a cooking target into and out of a cooking space. Accordingly, there is a problem in that the user experiences some inconvenience when a cooking target with a high weight needs to be cooked.

A cooking apparatus disclosed in Cited Reference below is configured to adjust a height to a rack for putting a cooking target thereon. However, an oven disclosed in Cited Reference below is disadvantageous in that the height to the rack is adjustable only within a cooling space and the adjustable height is not high, either.

In order to overcome inconvenience that a user experiences, there is a need to raise and lower a tray or rack with a cooking target put thereon in the state where the tray or the rack is drawn out and to raise the tray or the rack to a sufficient height corresponding to a degree by which a user does not necessarily bend his or her body.

However, Cited Reference below does not disadvantageously satisfy the above consumer demand.

That is, according to Cited Reference below, a height to a lathe is adjusted within a cooking chamber, and thus there is disadvantageously a limit on the height to which the lathe is capable of being raised.

Cited Reference: Korean Patent Publication No. 2015-0141797 (Dec. 21, 2015)

DISCLOSURE

Technical Problem

The present invention is proposed to overcome the above problem.

Technical Solution

In an aspect of the present invention, a cooking apparatus includes a case including an inner case having a cooking chamber formed therein and an outer case configured to surround the inner case, and having an open front surface, a tray put on the cooking chamber, a door coupled to the front surface of the case and configured to selectively open and close the open front surface, an elevating device installed at left and right internal surfaces of the inner case and configured to move the tray in forward and backward directions and upward and downward directions, wherein the elevating device includes a fixed rail fixed to an internal side surface of the inner case, a moveable rail configured to slide and move in forward and backward directions in a state where the moveable rail is coupled to the fixed rail, a support link configured to connect a side surface of the tray and the moveable rail, and a manipulator connected to the moveable rail and the support link.

The support link may include a front link, a rear link disposed at a point spaced apart backwards from the front link, wherein upper ends of the front link and the rear link are rotatably connected to the moveable rail, and wherein lower ends of the front link and the rear link are rotatably connected to the side surface of the tray.

The support link may further include a connection link configured to connect the front link and the rear link.

The connection link may be bent at a point spaced apart backwards from a front end, and the tray may be capable of being raised until at least one of the front link or the rear link reaches a bent portion of the connection link.

The cooking apparatus may further include a link axis configured to rotatably connect an upper end of the connection link to the moveable rail, the link axis may include a front link axis configured to connect the front link and the moveable rail, and a rear link axis configured to connect the rear link and the moveable rail, and the front link axis and the rear link axis may horizontally penetrate the moveable rail and protrude from an external surface of the moveable rail.

A cross section of each of the front link axis and the rear link axis, which protrudes from the external surface of the moveable rail, may include a race track shape having a pair of straight portions that face each other, and a pair of round portions that face each other, and a length of a first side connecting the pair of straight portions may be shorter than a length of a second side connecting the centers of the pair of round portions.

The fixed rail may include an adhesive portion closely adhered to a side surface of the inner case, an upper extension end that horizontally extends from an upper end of the adhesive portion, a lower extension end that horizontally extends from a lower end of the adhesive portion, and a guide extension end that horizontally extends from any point between the upper end and the lower end of the adhesive portion.

A space between the upper extension end and the lower extension end may be defined as a link axis accommodation portion configured to moveably accommodate the link axis, and a width of the link axis accommodation portion in upwards and downwards directions may have a size corresponding to a length of the first side.

The fixed rail may include a front axis groove formed at a point of the link axis accommodation portion, which is adjacent to a front end of the fixed rail, and a rear axis groove formed at a point of the link axis accommodation portion, which is spaced apart backwards from the front axis groove, and each of the front axis groove and the rear axis groove may be formed by a first recessed portion, which is formed by recessing a bottom surface of the upper extension end by a predetermined curvature, and a second recessed portion, which is formed by recessing an upper surface of the guide extension end by a predetermined curvature.

A distance between the front axis groove and the rear axis groove may be equal to a distance between the front link axis and the rear link axis.

A diameter of a circle that passes through the first recessed portion and the second recessed portion may have a size corresponding to a length of the second side.

In a state where the tray is drawn out by a maximum degree, the front link axis may be accommodated in the front axis groove, and the rear link axis may be accommodated in the rear axis groove.

The manipulator may include a connection rod having a rear end connected to the front link, a center plate having a first point to which a front end of the connection rod is rotatably connected, and a second point to which a front end of the moveable rail is rotatably connected, and a manipulation lever fixed to a third point of the center plate.

A line connecting the first to third points may form a triangle.

The first point may be formed at a higher point than the second point, and the third point may be formed between the first point and the second point.

The manipulation lever may include a lever rod having a rear end fixed to the third point, a lever rotatably connected to a front end of the lever rod, and a stopper protruding from an outer circumferential surface of the lever.

When the lever is rotated in a state where the tray is raised, the stopper may be caught by the front surface of the case.

The cooking apparatus may further include a rack formed on an external surface of the moveable rail, and a deceleration member engaged with the rack to be rotated and configured to limit speed at which the moveable rail is drawn out.

The deceleration member may include a fixed axis, a plurality of spokes that extends in a radial direction from an outer circumferential surface of the fixed axis, and a ring-shaped pinion configured to connect the plurality of spokes, and the pinion may be engaged with the rack to be rotated.

An upper end and a lower end of the fixed axis may be respectively fixed to an upper flange and a lower flange, which extend from the case, the plurality of spokes may be formed of a material having predetermined elastic force, and at least a portion of the pinion may penetrate the fixed rail and is engaged with the rack.

Advantageous Effects

A cooking apparatus configured as described above according to an embodiment of the present invention may have the following effects.

First, a tray may be raised in a state where the tray is drawn output from a cabinet, and thus when a user puts a cooking target on the tray or lifts up completely cooked food from the tray, it may be advantageous that the user needs not largely bend his or her body.

Second, the cooking apparatus includes a safety device for preventing a rail from being moved back in a state where the tray is raised, and a safety device for preventing the tray from being moved downwards due to self-load, and thus usage safety may be advantageously ensured.

Third, the tray may be raised in a state where the tray is drawn output from a cabinet, and thus it may be advantageous that the tray is capable of being raised to a height close to an upper end of the cabinet and that food is prevented from colliding with the tray while the tray is raised.

BEST MODE

Hereinafter, a cooking apparatus including a tray elevating device according to an embodiment of the present invention will be described in detail by way of an example of an oven.

Figure 1:
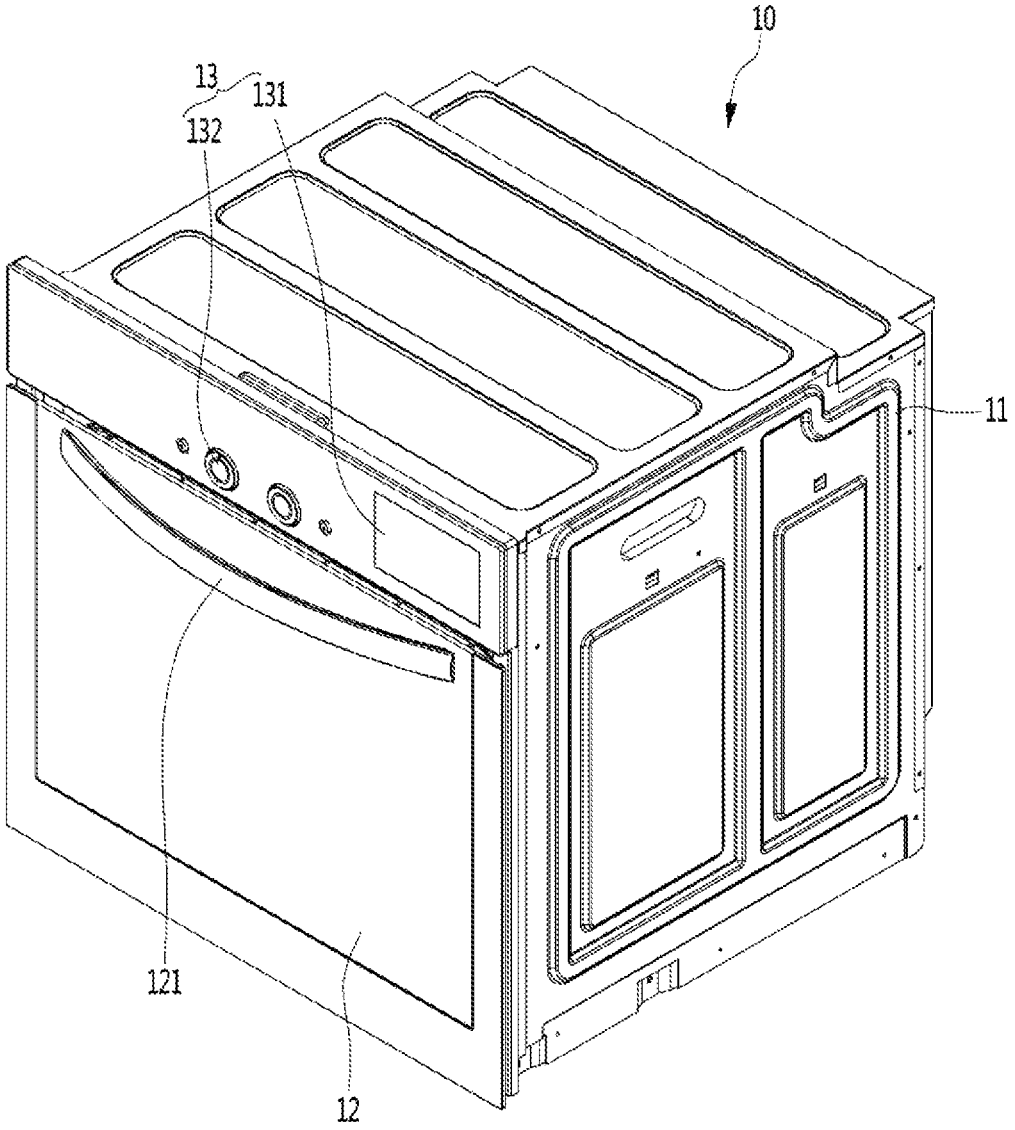
FIG. 1 is a perspective view of a cooking apparatus including elevating devices according to an embodiment of the present invention.
Figure 2:
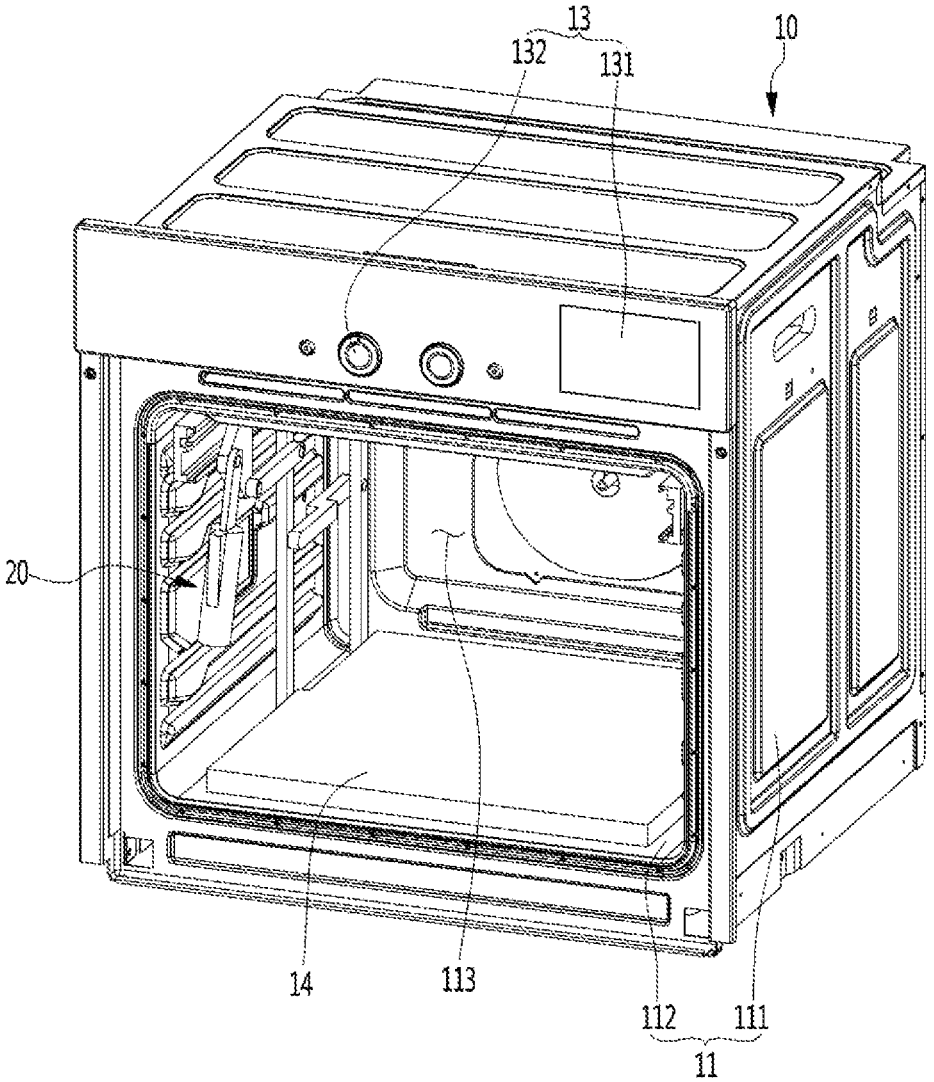
FIG. 2 is a perspective view of a cooking apparatus and shows an internal portion of a cooking chamber before elevating devices are operated.
Figure 3:
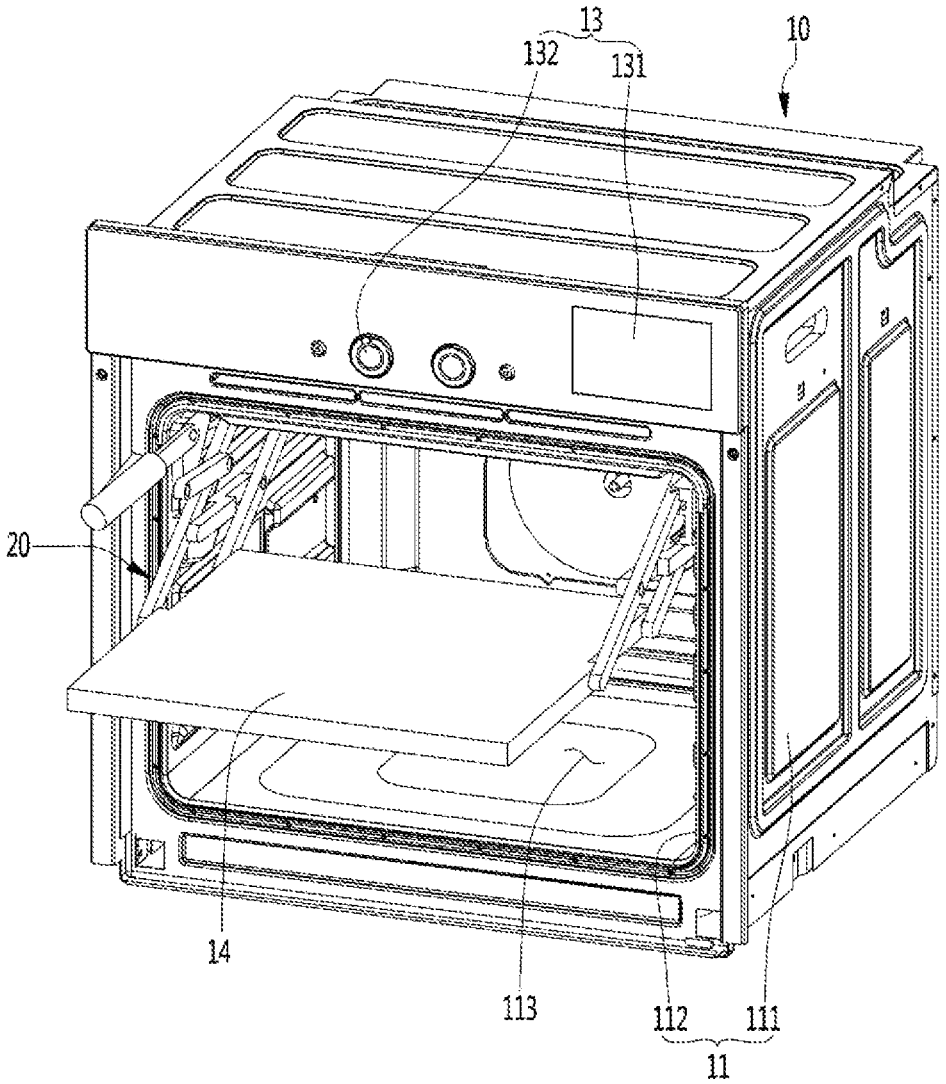
FIG. 3 is a perspective view of a cooking apparatus and shows an internal portion of a cooking chamber in the state where an operation of elevating devices is completed.

FIG. 1 is a perspective view of a cooking apparatus including elevating devices according to an embodiment of the present invention. FIG. 2 is a perspective view of a cooking apparatus and shows an internal portion of a cooking chamber before elevating devices are operated. FIG. 3 is a perspective view of a cooking apparatus and shows an internal portion of a cooking chamber in the state where an operation of elevating devices is completed.

Referring to FIGS. 1 to 3, a cooking apparatus 10 according to an embodiment of the present invention may include a case 11 including a cooking chamber 113 formed therein and having an open front surface, a door 12 configured to selectively open and close the open front surface of the case 11, and a control panel 13 installed at a portion of the front surface of the case 11, which corresponds to an upper side of the door 12.

In detail, various components required to cook food as well as a heater may be installed within the case 11, a description of which is omitted here, and only components that are related directly to an operation of the elevating devices will be described.

The case 11 may include an outer case 111 and an inner case 112 disposed inside the outer case 111. The cooking chamber 113 may be disposed inside the inner case 112. In addition, a tray 14 with food put thereon may be installed on an internal bottom of the inner case 112.

Elevating devices 20 according to an embodiment of the present invention may be installed at left and right internal surfaces of the inner case 112 and may be connected to each of an edge of the left surface and an edge of the right surface of the tray 14.

Hereinafter, only an elevating device disposed at one side from a pair of the elevating devices 20 disposed at the left and right sides of the tray 14 is denoted by a reference numeral and each component will be described. A pair of the elevating devices 20 disposed at the left and right sides of the tray 14 may have the same configuration except that some components as well as a grip portion are disposed in only one of the elevating devices 20 at the left and right sides, but it is noted that inclusion of some components in the elevating devices 20 disposed at the both sides also falls within the scope of the present invention.

A door handle 121 may be disposed on the front surface of the door 12, and the door 12 may be rotatably coupled to a lower end of the front surface of the case 11 by a hinge.

The control panel 13 may include a manipulator 132 configured to input various commands, and a display unit 131 configured to display the command input through the manipulator 132 or a driving state of the cooking apparatus 10.

Figure 4:
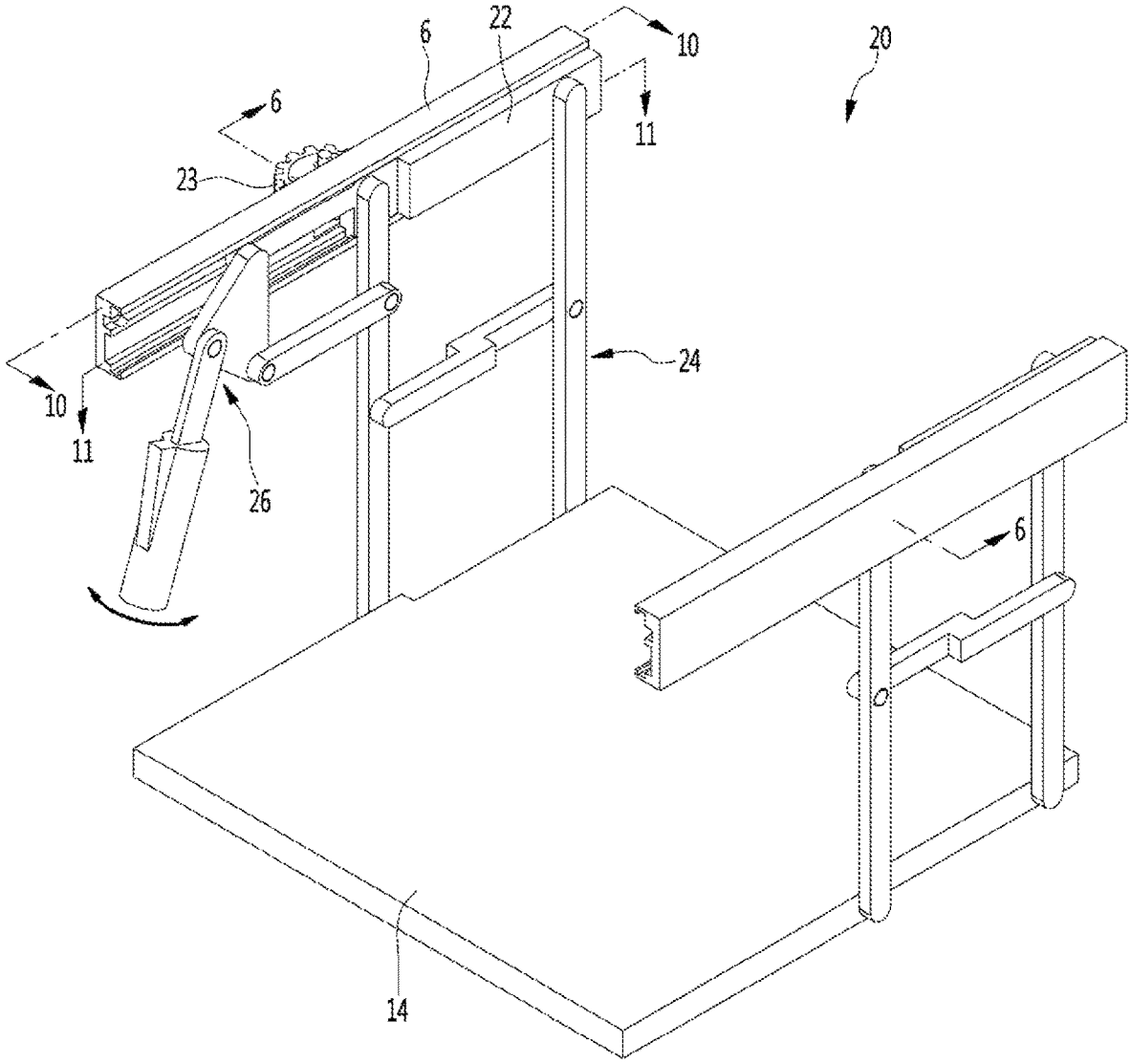
FIG. 4 is a perspective view of an elevating device according to an embodiment of the present invention.
Figure 5:
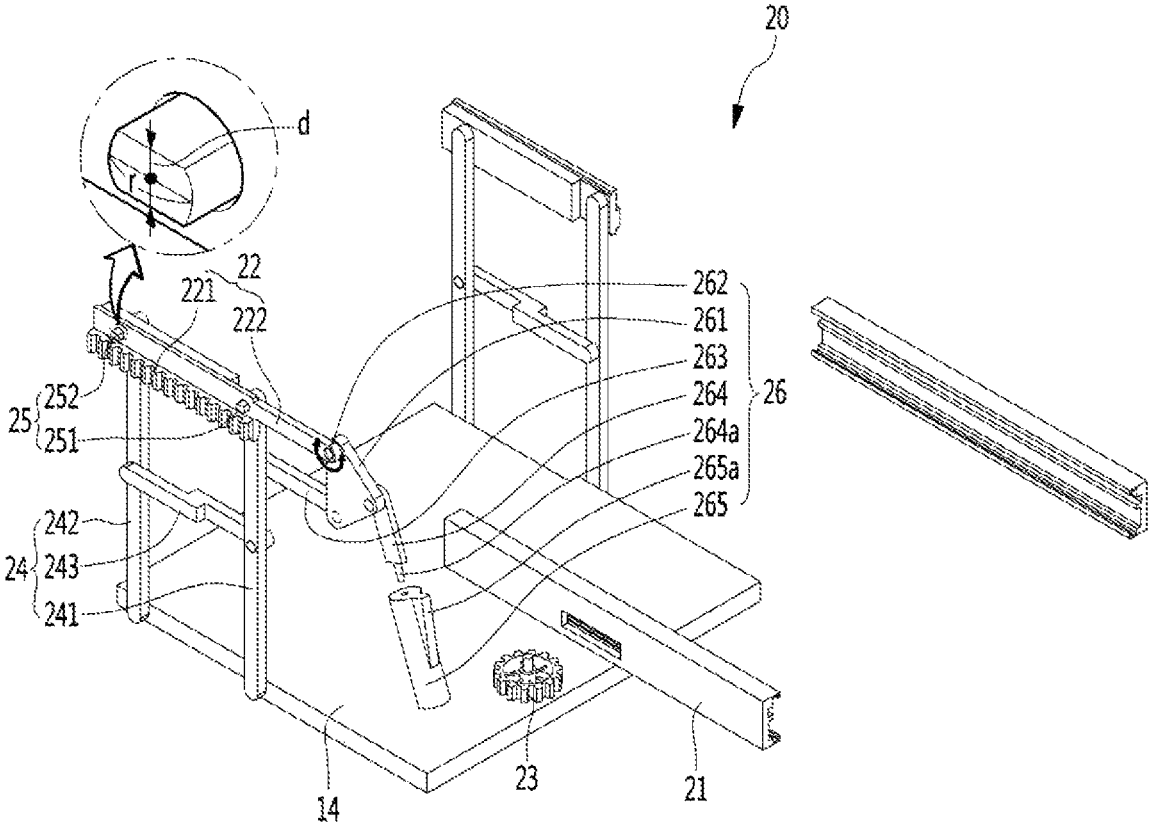
FIG. 5 is an exploded perspective view of the elevating device.
Figure 6:
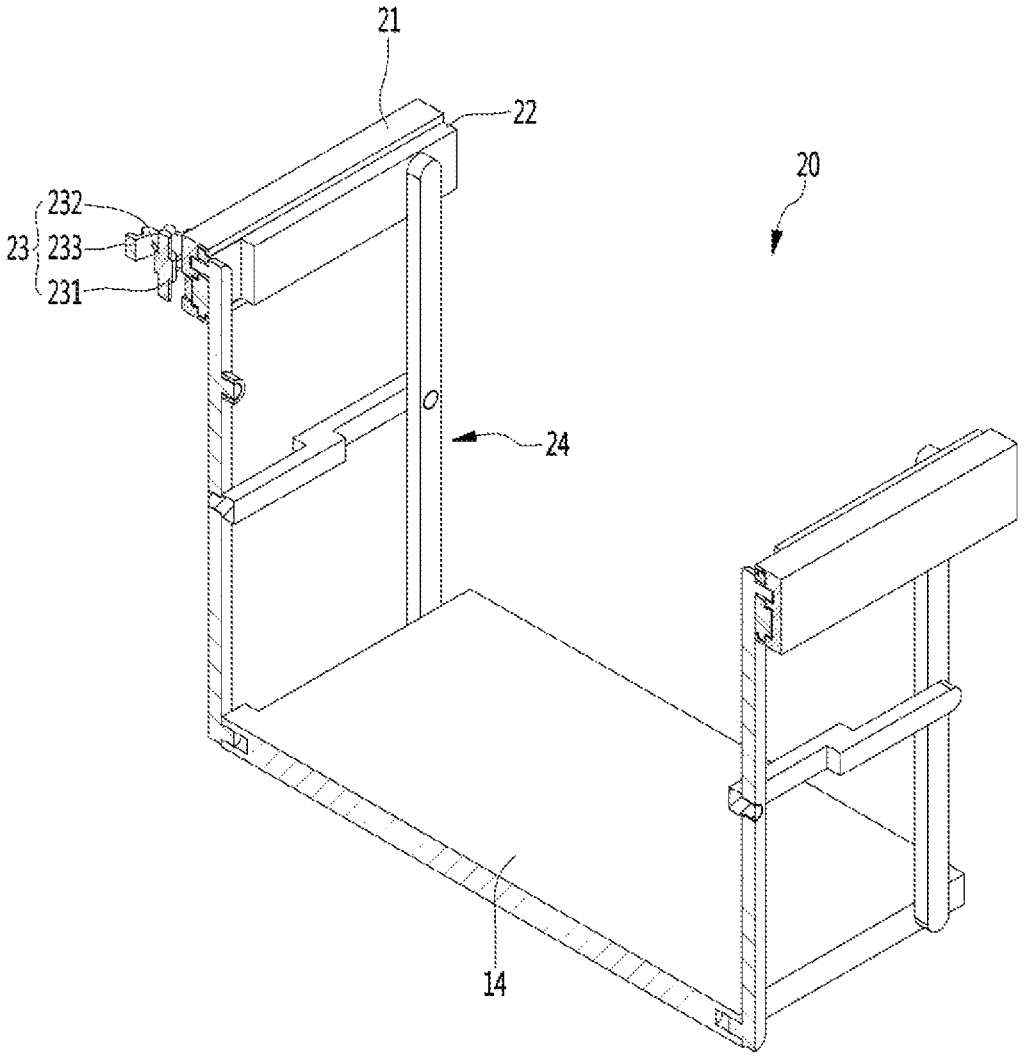
FIG. 6 is an exploded cross-sectional view taken along 6-6 of FIG. 5.
Figure 7:
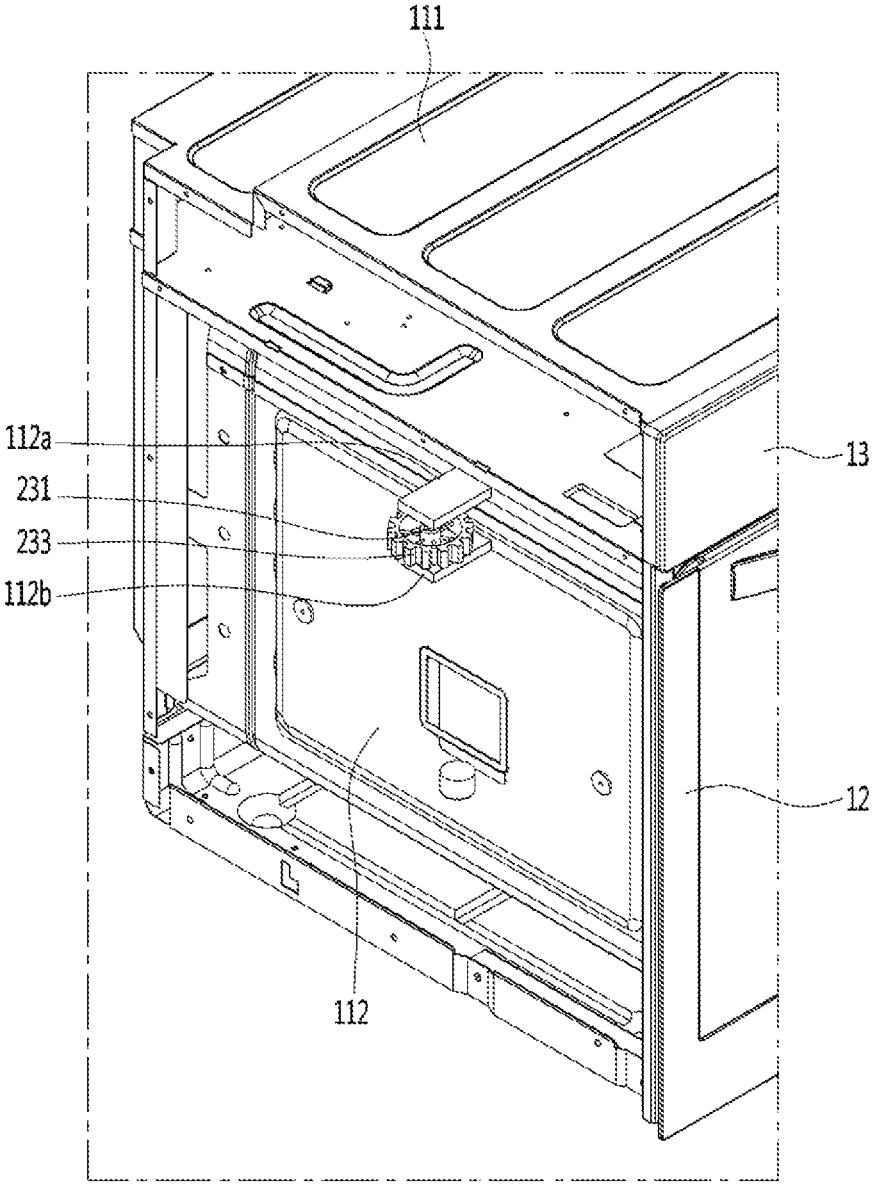
FIG. 7 is a side perspective view of a cooking apparatus in a state where an outer case is removed.

FIG. 4 is a perspective view of an elevating device according to an embodiment of the present invention. FIG. 5 is an exploded perspective view of the elevating device. FIG. 6 is an exploded cross-sectional view taken along 6-6 of FIG. 5. FIG. 7 is a side perspective view of a cooking apparatus in a state where an outer case is removed.

Referring to FIGS. 4 to 7, the elevating devices 20 according to an embodiment of the present invention may be provided on an inner circumferential surface of the case 11, in detail, on opposite internal side surfaces of the inner case 112, respectively. Hereinafter, any one of a pair of the elevating devices 20 will be exemplified.

In detail, the elevating device 20 may include a fixed rail 21 fixed to an internal side surface of the inner case 112, a moveable rail 22 slidably and moveably connected to the fixed rail 21, a deceleration member 23 (refer to FIG. 7) coupled to an external side surface of the inner case 112 and configured to limit speed at which the moveable rail 22 is drawn out, a support link 24 configured to connect the moveable rail 22 and a side surface of the tray 14, a link axis 25 configured to rotatably connect an upper end of the support link 24 to the moveable rail 22, and a manipulator 26 connected to the moveable rail 22 and configured to rotate the support link 24.

The structure of the fixed rail 21 will be described in more detail with reference to the drawings.

The moveable rail 22 may have upper and lower surfaces, front and rear surfaces, an internal surface that is exposed to the cooking chamber 113 in a state where the moveable rail 22 is coupled to the fixed rail 21, and an external surface that is an opposite surface to the front surface.

In detail, an extension portion 222 may extend by a predetermined length on the front surface of the moveable rail 22. The extension portion 222 may be configured as a single body along with the moveable rail 22 and may be defined as a part of the moveable rail 22, or alternatively the extension portion 222 may be coupled to the front surface of the moveable rail 22 by a coupling member.

The extension portion 222 may be formed at only one of the left and right moveable rails. That is, the manipulator 26 may be formed at only one of the left and right elevating devices, and the extension portion 222 may be formed or disposed on the front surface of the moveable rail included in the elevating device at which the manipulator 26 is formed. However, when the manipulator 26 is disposed at both the left and right elevating devices, the extension portion 222 may also be formed at the left and right moveable rails. According to the present embodiment, the case where the manipulator 26 is disposed only at the left elevating device 20 is exemplified.

A rack 221 may be formed on the external surface of the moveable rail 22. The rack 221 may be formed throughout rear and front ends of the moveable rail 22. The link axis 25 may be disposed on the external surface of the moveable rail 22 except for a portion on which the rack 221 is formed.

In detail, the external surface of the moveable rail 22 may be stepped, and a surface on which the link axis 25 is formed may be lower than a surface on which the rack 221 is formed.

The link axis 25 may include a front link axis 251 and a rear link axis 252. The front link axis 251 may horizontally penetrate the moveable rail 22 at a point close to a front end of the moveable rail 22. The rear link axis 252 may horizontally penetrate the moveable rail 22 at a point close to a rear end of the moveable rail 22.

A portion of the link axis 25 may protrude from the external surface of the moveable rail 22 and may be exposed to the outside. The portion of the link axis 25, which protrudes from the external surface of the moveable rail 22, may have a non-circular cross section. In detail, the cross section of the portion of the link axis 25, which protrudes from the external surface of the moveable rail 22, may have a race track shape having a pair of straight portions that face each other, and a pair of round portions that face each other. That is, a distance 'r' between the pair of straight portions may be longer than a distance 'd' between the pair of round portions.

An upper end of the support link 24 may be connected to a portion of the link axis 25, which protrudes from the internal surface of the moveable rail 22.

In detail, the support link 24 may include a front link 241 having an upper end connected to the front link axis 251 and a rear ink 242 having an upper end connected to the rear link axis 252. In addition, the front link 241 and the rear ink 242 may be connected to each other by a connection link 243. The front link 241 and the rear ink 242 may be rotated as one body along with the front link axis 251 and the rear link axis 252, respectively.

Rear ends of the front link 241 and the rear ink 242 may be rotatably connected to a side surface portion of the tray 14.

The manipulator 26 may include a connection rod 263 having a rear end that is rotatably connected to a point of the front link 241, which is spaced apart downwards from an upper end of the front link 241 by a predetermined distance, a center plate 261 to which a front end of the extension portion 222 and a front end of the connection rod 263 are rotatably connected, and a manipulation lever having a rear end fixed to the center plate 261.

In detail, the center plate 261 may be shaped like a triangle, and the front ends of the extension portion 222 and the connection rod 263 may be rotatably connected to two corners of the center plate 261. The manipulation lever may be fixed to the remaining one corner of the center plate 261.

Here, the shape of the center plate 261 is not limited to a triangle. That is, the center plate 261 may have any shape as long as an approximately triangular shape is configured by connecting points to which the extension portion 222, the connection rod 263, and the manipulation lever are connected, respectively.

However, the front end of the extension portion 222 and the front end of the connection rod 263 need to be rotatably connected to the center plate 261, and the manipulation lever needs to be non-rotatably connected to the center plate 261.

In more detail, the manipulation lever may include a lever rod 264 having a rear end fixed to a corner of the center plate 261, and a lever 265 that is rotatably connected to the front end of the lever rod 264.

In detail, a core shaft 264*a* may extend from the center of the front end of the lever rod 264 and may be inserted into a rear end of the lever 265. The lever 265 may be rotatable clockwise and counterclockwise around the core shaft 264*a*. A stopper 265*a* may protrude from an outer circumferential surface of the lever 265.

Here, it is noted that a method of coupling the lever 265 to the lever rod 264 is not limited to the proposed structure. That is, a lever member that functions as a handle for manipulation of ascending and descending of the elevating devices 20 may be connected to the center plate 261, and may be any type of lever member as long as a portion of the lever member is capable of being rotated around the central axis of the lever member.

The deceleration member 23 may include a fixed axis 231 that vertically extends, a plurality of spokes 232 that extends in a radial direction from an outer circumferential surface of the fixed axis 231, and a circular pinion 233 for connecting ends of the plurality of spokes 232.

As shown in FIG. 7, an upper flange 112*a* and a lower flange 112*b* may extend from the external side surface of the inner case 112, and upper and lower ends of the fixed axis 231 may be fixed to the upper flange 112*a* and the lower flange 112*b*, respectively.

The plurality of spokes 232 may be formed of an elastically deformed material such as rubber or silicon. Accordingly, when the pinion 233 is rotated, the plurality of spokes 232 may repress rotation speed of the pinion 233 while being elastically deformed to be wound around the fixed axis 231. When the rotation speed of the pinion 233 is repressed, forwards speed of the moveable rail 22 may be repressed, which will be described below in more detail with reference to the drawings. Various devices for repressing the forwards speed of the moveable rail 22 may be proposed.

Figure 8:
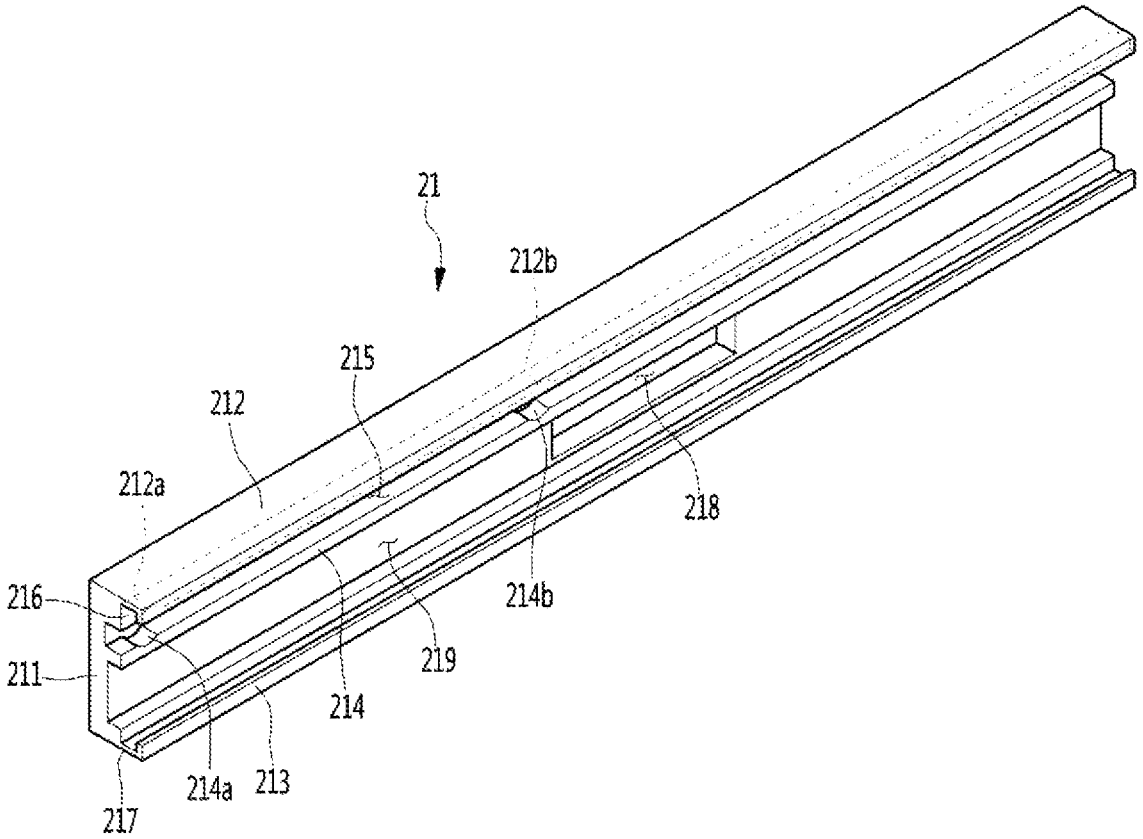
FIG. 8 is a perspective view of a fixed rail included in an elevating device according to an embodiment of the present invention.
Figure 9:
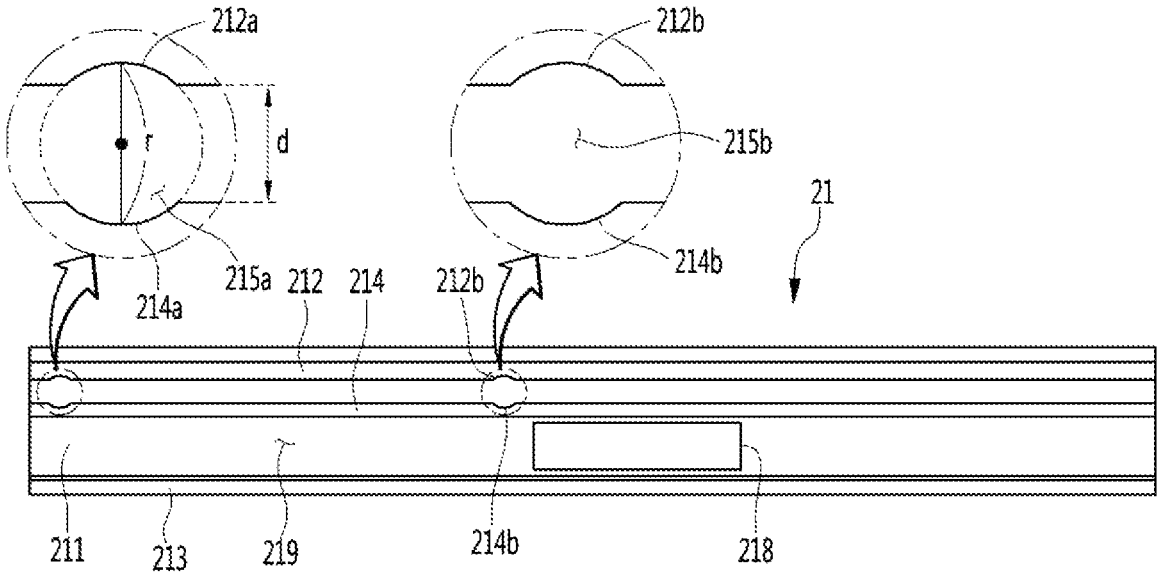
FIG. 9 is a side view of the fixed rail.

FIG. 8 is a perspective view of a fixed rail included in an elevating device according to an embodiment of the present invention. FIG. 9 is a side view of the fixed rail.

Referring to FIGS. 8 and 9, the elevating devices 20 according to an embodiment of the present invention may include the fixed rail 21, and the fixed rail 21 may be fixed to the internal side surface of the inner case 112. The fixed rail 21 may enable the moveable rail 22 to slide in forwards and backwards directions in the inner case 112.

In detail, the fixed rail 21 may include an adhesive portion 211 that is closely adhered to the internal side surface of the inner case 112, an upper extension end 212 that extends in a direction towards the center of the inner case 112 from an upper end of the adhesive portion 211, a lower extension end 213 that extends in a direction towards the center of the inner case 112 from a lower end of the adhesive portion 211, and a guide extension end 214 that extends in a direction towards the center of the inner case 112 from a point between the upper and lower ends of the adhesive portion 211.

Here, a portion of the adhesive portion 211, which is closely adhered to the inner case 112, may be defined as an external surface, and an opposite surface to the external surface, that is, a surface of the adhesive portion 211, which is exposed to the cooking chamber 113, may be defined as an internal surface. The upper extension end 212, the lower extension end 213, and the guide extension end 114 may be described to horizontally extend from the internal surface of the adhesive portion 211.

A space between the upper extension end 212 and the guide extension end 214 may be a space where the link axis 25 is moved and may be defined as a link axis accommodation portion 215. The width of the link axis accommodation portion 215 in upwards and downwards directions may has a length corresponding to a distance between the straight portions of the link axis 25. That is, the upper straight portion of the link axis 25 may contact a bottom surface of the upper extension end 212, and the link axis 25 may be moved in forwards and backwards directions in a state where the lower straight portion of the link axis 25 contacts the upper surface of the guide extension end 214.

A front axis groove 215*a* and a rear axis groove 215*b* may each be formed in the link axis accommodation portion 215. In detail, the front axis groove 215*a* may be formed at a point of the link axis accommodation portion 215, which is adjacent to the front end of the fixed rail 21, and the rear axis groove 215*a* may be formed at a point of the link axis accommodation portion 215, which is spaced apart backwards from the front axis groove 215*a* by a predetermined distance. A distance from the center of the front axis groove 215*a* to the center of the rear axis groove 215*b* may be set to be the same as a distance from the center of the front link axis 251 to the center of the rear link axis 252.

The front axis groove 215*a* may be defined by a front groove 212*a* that is formed by recessing the bottom surface of the upper extension end 212 by a predetermined depth, a front groove 214*a* that is formed by recessing the upper surface of the guide extension end 214 by a predetermined depth, and a space that defines the link axis accommodation portion 215. The front grooves 212*a* and 214*a* may be rounded with a predetermined radius of curvature.

Here, a radius of a circle that passes through the front grooves 212*a* and 214*a* may be equal to a major radius r/2 of the link axis 25, and accordingly, in a state where the major radius of the link axis 25 is vertically positioned, an entire rounded curved portion of the link axis 25 may be completely and closed adhered to the front grooves 212*a* and 214*a*.

On the other hand, in a state where the major radius of the link axis 25 is horizontally positioned, a line that passes through the curved portion of the link axis 25 and the front grooves 212*a* and 214*a* may configure a complete circle, and a radius of the circle may correspond to the major radius of the link axis 25.

The rear axis groove 215*b* may be defined by rear grooves 212*b* and 214*b* that are formed on the bottom surface of the upper extension end 212 and the upper surface of the guide extension end 214, respectively, and a space that defines the link axis accommodation portion 215.

A relationship between the rear axis groove 215*b* and the rear grooves 212*b* and 214*b*, and the link axis 25 is the same as a relationship between the front axis groove 215*b* and the front grooves 212*a* and 214*a*, and the link axis 25, and thus a repeated description is omitted here.

When the moveable rail 22 is drawn out by a maximum degree, the front link axis 251 may be accommodated in the front axis groove 215*a* and the rear link axis 252 may be accommodated in the rear axis groove 215*b*. The link axis 25 is not capable of being rotated prior to reaching the front axis groove 215*a* and the rear axis groove 215*b*.

The width 'd' of the link axis accommodation portion 215 in upwards and downwards directions may correspond to twice the length of a minor radius d/2 of the link axis 25, and thus the link axis 25 may be rotated and the major radius of the link axis 25 is vertically positioned only when the link axis 25 is completely accommodated in the front axis groove 215*a* and the rear axis groove 215*b*.

A rack accommodation portion 219 that is a portion that accommodates the rack 221 may be defined between the guide extension end 214 and the lower extension end 213. A opening 218 may be formed in the adhesive portion 211 that defines the rack accommodation portion 219. The opening 218 may be formed at a point of the adhesive portion 211, which is spaced apart backwards from the front end of the fixed rail 21 by a predetermined distance, and a portion of the deceleration member 23 may penetrate the opening 218 and may be exposed to the rack accommodation portion 219.

Here, a degree by which the deceleration member 23 is exposed to the rack accommodation portion 219 may be sufficient as long as the pinion 233 is stably engaged with the rack 221 of the moveable rail 22.

It may be sufficient as long as the width of the opening 218 in upwards and downwards direction is greater than the thickness (the width in upwards and downwards direction) of the pinion 233.

The deceleration member 23 may be installed at any position as long as the pinion 233 is kept being engaged with the rack 221 even in a state where the moveable rail 22 is drawn out by a maximum degree. A position of the opening 218 may be set in such a way that a vertical surface that passes through the fixed axis 231 of the deceleration member 23 passes through the center of the opening 218.

An upper guide groove 216 may be recessed by a predetermined depth on the bottom surface of the upper extension end 212 and may extend by a length corresponding to the length of the upper extension end 212. A portion of an upper surface of the moveable rail 22 may be inserted into the upper guide groove 216. For example, a protrusion (or rib) that protrudes from the center of the upper surface of the moveable rail 22 and extends by a length corresponding to the length of the moveable rail 22 may be inserted into the upper guide groove 216.

A lower guide groove 217 that is the same as the upper guide groove 216 may also be recessed on the bottom surface of the lower extension end 213. A protrusion (or rib) may also protrude from a bottom surface of the moveable rail 22 and may be inserted into the lower guide groove 217. Then, in a state where the moveable rail 22 is installed in the fixed rail 21, the moveable rail 22 may be slidably moved in forwards and backwards directions without a shake in right and left directions.

Figure 10:
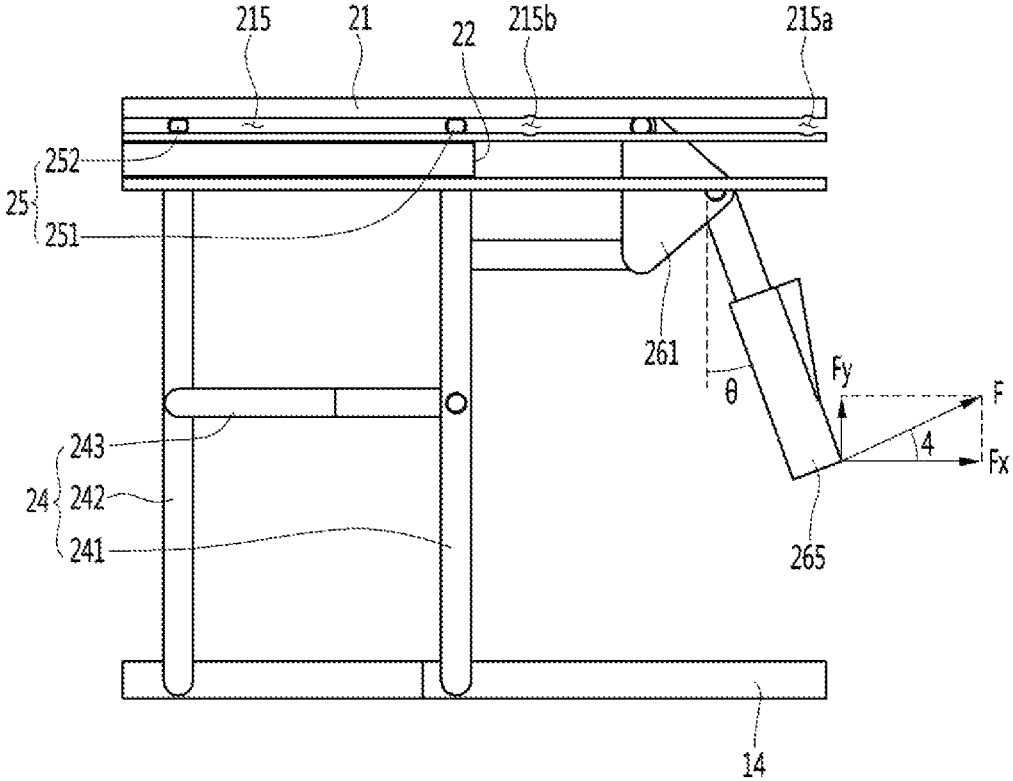
FIG. 10 is a longitudinal cross-sectional view taken along 10-10 of FIG. 4 immediately before a tray is drawn out.
Figure 11:
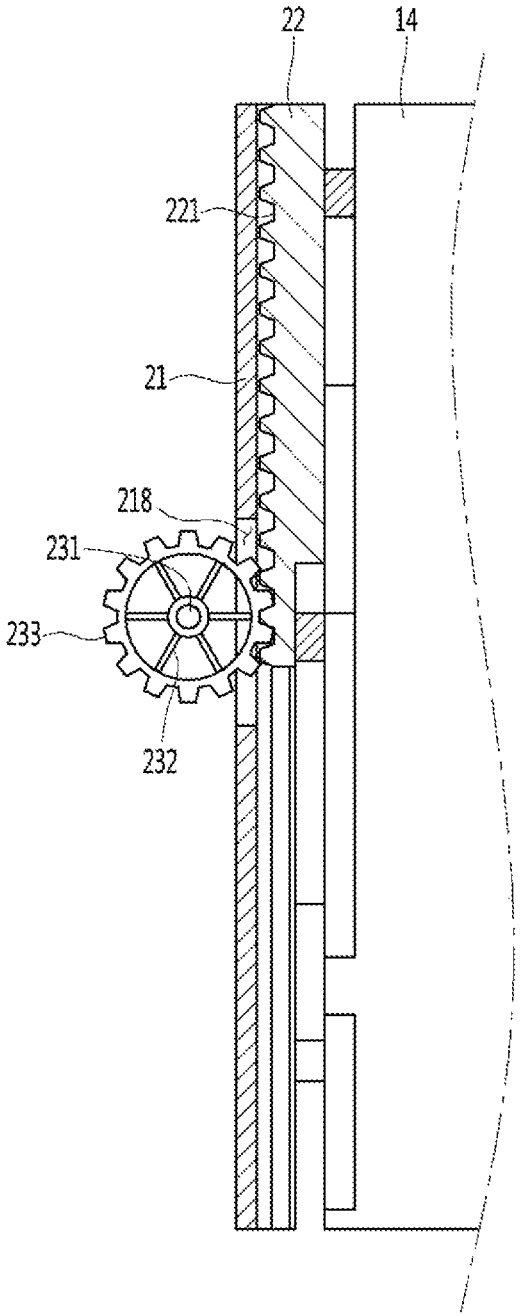
FIG. 11 is a lateral cross-sectional view taken along 11-11 of FIG. 4 immediately before a tray is drawn out.

FIG. 10 is a longitudinal cross-sectional view taken along 10-10 of FIG. 4 immediately before a tray is drawn out. FIG. 11 is a lateral cross-sectional view taken along 11-11 of FIG. 4 immediately before a tray is drawn out.

Referring to FIGS. 10 and 11, before the tray 14 is drawn out, the support link 24 is moved back to a rearmost side. The support link 24 and the tray 14 may be kept being perpendicular to each other.

In detail, the front link axis 251 and the rear link axis 252 that penetrate the upper end of the support link 24 may also be moved back to the rearmost side. That is, the front link axis 251 may be positioned behind the rear axis groove 215*b*.

The lever 265 may be kept being inclined towards a front side of the case 11 from a vertical surface by a predetermined angle θ. That is, when the lever rod 264 is fixedly coupled to the center plate 261, the lever rod 264 may be coupled to the center plate 261 to be inclined by the predetermined angle θ from the vertical surface. In this state, when a user pulls the lever 265 in order to draw out the tray 14, force F for pulling the lever 265 may be exerted in a direction in which the lever 265 is inclined upwards from a horizontal surface by a predetermined angle cp.

In detail, in order for a user to lift up the lever 265 to raise a lathe 14, a user hand may be positioned at a higher point than the lever 265 in a state where the user stand straight. Then, in a state where the user slightly bends his or her body, force Fx for pulling the lever 265 forwards and force Fy for lifting up the lever 265 may be simultaneously applied to the lever 265 to smoothly move forward and raise the tray 14.

Even if the tray 14 is not raised, the pinion 233 of the deceleration member 23 may be kept being engaged with the rack 221 of the moveable rail 22. In this state, the pinion 233 may be kept being engaged with a portion of the rack 221, which is close to the front end of the moveable rail 22.

Figure 12:
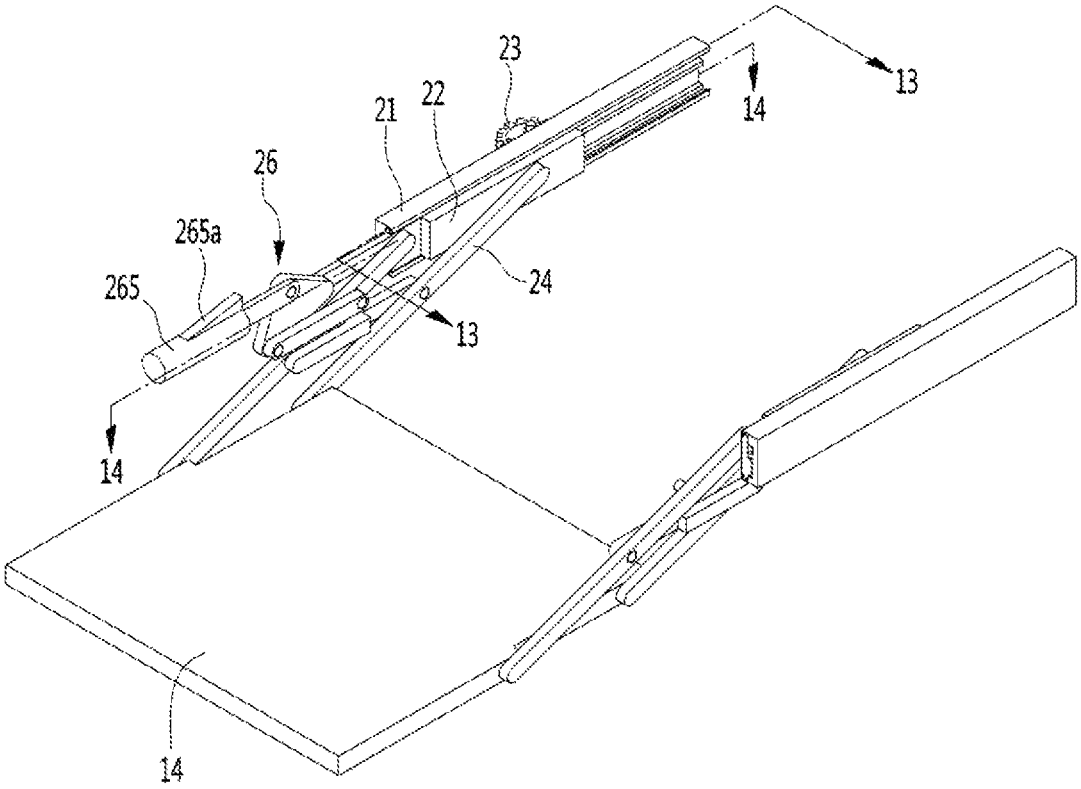
FIG. 12 is a perspective view showing a state where a tray is drawn out from a cooking chamber and is raised by a maximum degree.
Figure 13:
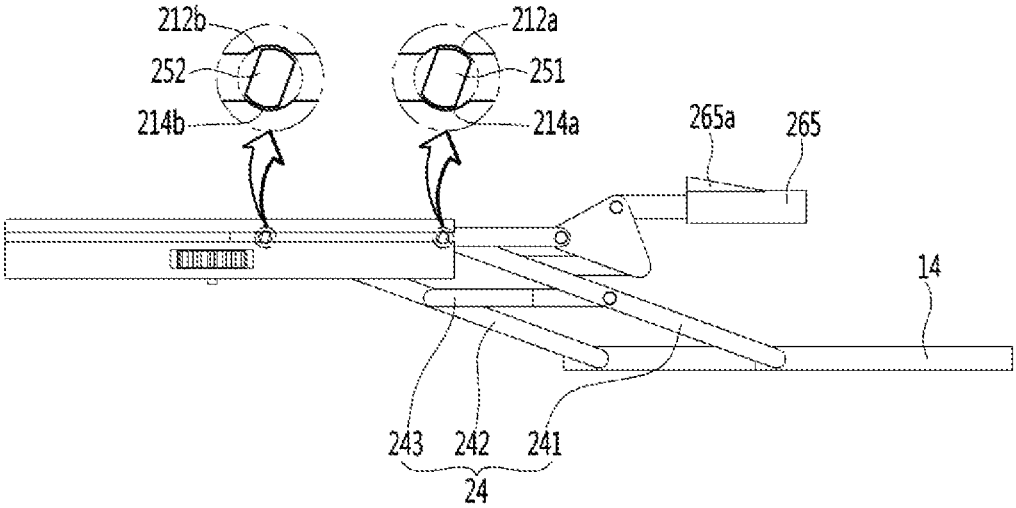
FIG. 13 is a longitudinal cross-sectional view taken along 13-13 of FIG. 12 in a state where a tray is raised by a maximum degree.
Figure 14:
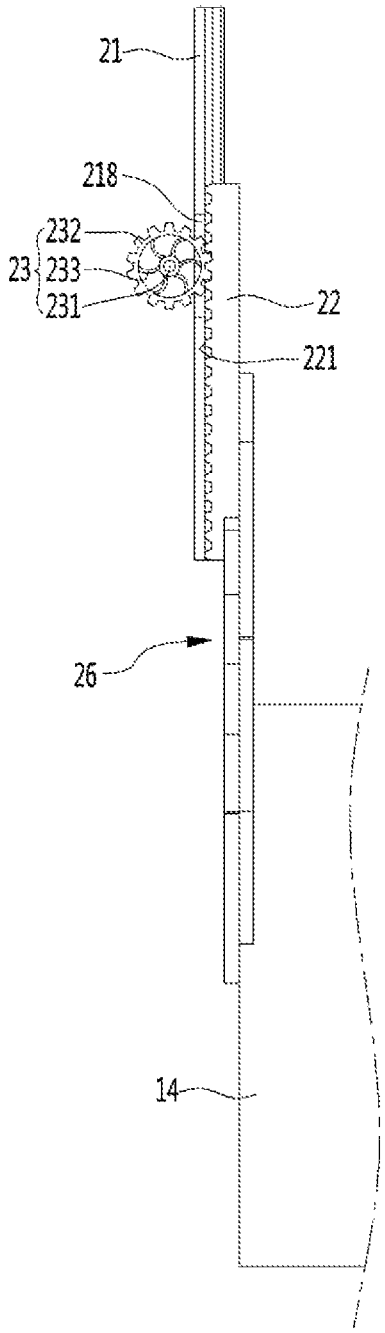
FIG. 14 is a lateral cross-sectional view taken along 14-14 of FIG. 12 in a state where a tray is raised by a maximum degree.

FIG. 12 is a perspective view showing a state where a tray is drawn out from a cooking chamber and is raised by a maximum degree. FIG. 13 is a longitudinal cross-sectional view taken along 13-13 of FIG. 12 in a state where a tray is raised by a maximum degree. FIG. 14 is a lateral cross-sectional view taken along 14-14 of FIG. 12 in a state where a tray is raised by a maximum degree.

Referring to FIGS. 12 to 14, in order to raise the tray 14, it is required to completely drawn out the tray 14 from the cooking chamber 113. Otherwise, food put on the tray 14 may collide with an upper surface of the case 11.

In detail, the user may pull the lever 265 to allow the tray 14 to be moved forward by a maximum degree. When the tray 14 is drawn out by a maximum degree, the front link axis 251 and the rear link axis 252 may be completely accommodated in the front axis groove 215*a* and the rear axis groove 215*b*, respectively.

When the moveable rail 22 is moved forwards, force F that is inclined upward is applied to the lever 265, and thus moment may be applied to the center plate 261 by force in a direction of a vertical axis.

In detail, by virtue of the force F, torque may be applied around a hinge axis for connecting the center plate 261 and the extension portion 222 and may function as force for pulling the connection rod 263 forwards. As a result, moment for rotation around the front link axis 251 and the rear link axis 252 may be applied to the front link 241 and the rear ink 242.

However, as described above, in a state where major radii r/2 of the front link axis 251 and the rear link axis 252 are positioned in parallel to each other, it is not possible to rotate the front link axis 251 and the rear link axis 252 even if the torque is applied. At a moment at which the front link axis 251 and the rear link axis 252 are completely accommodated in the front axis groove 215*a* and the rear axis groove 215*b*, the front link axis 251 and the rear link axis 252 may be rotated, as shown in FIG. 13.

Due to this structure, in a state where the lever 265 is pulled, even if rotation force is applied to the support link 24, the tray 14 may not be raised until the tray 14 is drawn out by a maximum degree.

It may be necessary to limit the rotation amplitude of the front link 241 and the rear ink 242 and to limit a height to which the tray 14 is raised by a maximum degree. As a method for overcoming this, the connection link 243 may be bent at any point, as shown in the drawing. The tray 14 may be raised until at least one of the front link 241 or the rear ink 242 reaches a bent portion of the connection link 243.

In order to raise the tray 14, the tray 14 may be raised in a state where the tray 14 is drawn out forward by a maximum degree and is stopped. However, when speed at which the tray 14 is drawn out is excessively high, there is a risk that food put on the tray 14 leans forwards or is inverted by inertial force of the tray 14 at a moment at which the tray 14 is drawn out by a maximum degree. Accordingly, as the tray 14 approaches a point at which the tray 14 is drawn out by a maximum degree, the speed at which the tray 14 is drawn out may be reduced.

As such, in order to reduce the speed at which the tray 14 is drawn out, the deceleration member 23 may be provided.

In detail, as shown in FIG. 13, the fixed axis 231 of the deceleration member 23 may be kept being fixed rather than being rotated, and the pinion 233 may be rotated by moving the moveable rail 22 forwards.

Then, the spokes 232 having elastic force may be bent by rotation of the pinion 233 and may be wound around the outer circumferential surface of the fixed axis 231. Elastic restoring force may be accumulated as the spokes 232 are bent, and thus the speed at which the tray 14 is drawn out may be gradually reduced.

Even in a state where the tray 14 is drawn out by a maximum degree, the pinion 233 needs to be kept being engaged with the rack 221. Otherwise, this is because a deceleration function of reducing the speed at which the tray 14 is drawn out is released.

Figure 15:
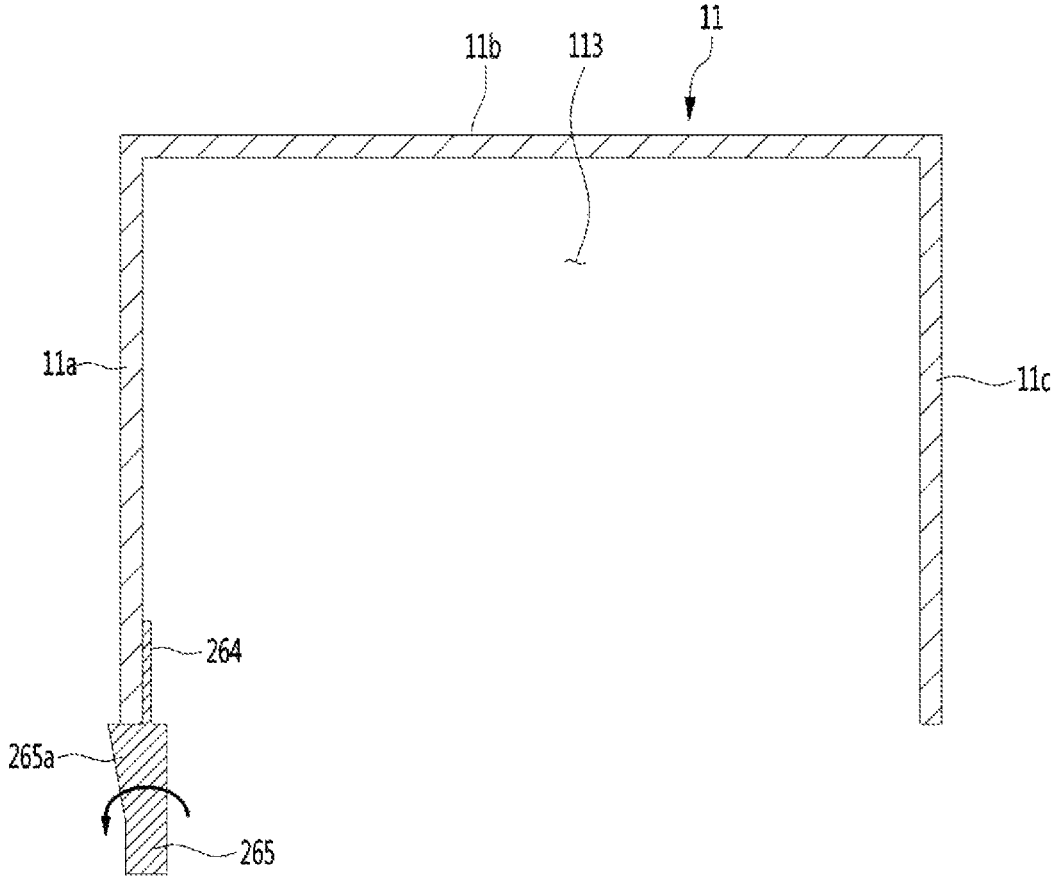
FIG. 15 is a lateral cross-sectional view of a cooking apparatus in a state where a lever is manipulated to keep a tray being raised.

FIG. 15 is a lateral cross-sectional view of a cooking apparatus in a state where a lever is manipulated to keep a tray being raised.

Referring to FIG. 15, in a state where a user raises the tray 14 to a maximum height, the user may need to use both hands in order to lift up food or a food container put on the tray 14.

In this situation, the user may need to take his or her hand off the lever 265. In this case, even if the user hand is taken off the lever 265, the tray 14 needs to be kept being raised. To this end, there is a need for a device for keeping the tray 14 being raised.

In detail, the lever 265 may be rotatably coupled to the lever rod 264. The stopper 265*a* may protrude from the outer circumferential surface of the lever 265. In a state where the tray 14 is raised by a maximum degree, the lever 265 may become in a horizontal state, and the lever 265 may be rotated in this state, and thus the stopper 265*a* may be caught by a front end of a side surface of the case 11.

In more detail, the case 11 may have a left surface portion 11*a*, a right surface portion 11*c*, and a rear surface portion 11*b*, and the stopper 265*a* may be caught by a front end of the left surface portion 11*a* or the right surface portion 11*c* of the case 11.

In this state, even if the user takes his or her hand off the lever 265, the tray 14 may be kept being raised.

The invention claimed is:

1. A cooking apparatus, comprising:

a case including an inner case having a cooking chamber formed therein and an outer case configured to surround the inner case, and having an open front surface;

a tray put on the cooking chamber;

a door coupled to the front surface of the case and configured to selectively open and close the open front surface;

an elevating device installed at left and right internal surfaces of the inner case and configured to move the tray in forward and backward directions and upward and downward directions, wherein the elevating device includes:

a fixed rail fixed to an internal side surface of the inner case;

a moveable rail configured to slide and move in forward and backward directions in a state where the moveable rail is coupled to the fixed rail;

a support link configured to connect a side surface of the tray and the moveable rail; and a manipulator connected to the moveable rail and the support link, wherein the support link includes:

a front link;

a rear link disposed at a point spaced apart backwards from the front link, wherein upper ends of the front link and the rear link are rotatably connected to the moveable rail, wherein lower ends of the front link and the rear link are rotatably connected to the side surface of the tray, wherein the support link further includes a connection link configured to connect the front link and the rear link, wherein the connection link is bent at a point spaced apart backwards from a front end, and wherein the tray is capable of being raised until at least one of the front link or the rear link reaches a bent portion of the connection link.

2. The cooking apparatus of claim 1, further comprising a link axis configured to rotatably connect an upper end of the support link to the moveable rail, wherein the link axis includes a front link axis configured to connect the front link and the moveable rail, and a rear link axis configured to connect the rear link and the moveable rail, and wherein the front link axis and the rear link axis horizontally penetrate the moveable rail and protrude from an external surface of the moveable rail.

3. The cooking apparatus of claim 2, wherein a cross section of each of the front link axis and the rear link axis, which protrudes from the external surface of the moveable rail, includes a race track shape having a pair of straight portions that face each other, and a pair of round portions that face each other, and wherein a length of a first side connecting the pair of straight portions is shorter than a length of a second side connecting the centers of the pair of round portions.

4. The cooking apparatus of claim 3, wherein the fixed rail includes:

an adhesive portion closely adhered to a side surface of the inner case;

an upper extension end that horizontally extends from an upper end of the adhesive portion;

a lower extension end that horizontally extends from a lower end of the adhesive portion; and a guide extension end that horizontally extends from any point between the upper end and the lower end of the adhesive portion.

5. The cooking apparatus of claim 4, wherein a space between the upper extension end and the lower extension end is defined as a link axis accommodation portion configured to moveably accommodate the link axis, and wherein a width of the link axis accommodation portion in upwards and downwards directions has a size corresponding to a length of the first side.

6. The cooking apparatus of claim 5, wherein the fixed rail includes:

a front axis groove formed at a point of the link axis accommodation portion, which is adjacent to a front end of the fixed rail; and a rear axis groove formed at a point of the link axis accommodation portion, which is spaced apart backwards from the front axis groove, and wherein each of the front axis groove and the rear axis groove is formed by a first recessed portion, which is formed by recessing a bottom surface of the upper extension end by a predetermined curvature, and a second recessed portion, which is formed by recessing an upper surface of the guide extension end by a predetermined curvature.

7. The cooking apparatus of claim 6, wherein a distance between the front axis groove and the rear axis groove is equal to a distance between the front link axis and the rear link axis.

8. The cooking apparatus of claim 6, wherein a diameter of a circle that passes through the first recessed portion and the second recessed portion has a size corresponding to a length of the second side.

9. The cooking apparatus of claim 6, wherein, in a state where the tray is drawn out by a maximum degree, the front link axis is accommodated in the front axis groove, and the rear link axis is accommodated in the rear axis groove.

10. The cooking apparatus of claim 1, wherein the manipulator includes a connection rod having a rear end connected to the front link, a center plate having a first point to which a front end of the connection rod is rotatably connected, and a second point to which a front end of the moveable rail is rotatably connected, and a manipulation lever fixed to a third point of the center plate.

11. The cooking apparatus of claim 10, wherein a line connecting the first to third points forms a triangle.

12. The cooking apparatus of claim 11, wherein the first point is formed at a higher point than the second point, and the third point is formed between the first point and the second point.

13. The cooking apparatus of claim 10, wherein the manipulation lever includes:

a lever rod having a rear end fixed to the third point;

a lever rotatably connected to a front end of the lever rod; and a stopper protruding from an outer circumferential surface of the lever.

14. The cooking apparatus of claim 13, wherein, when the lever is rotated in a state where the tray is raised, the stopper is caught by the front surface of the case.

15. The cooking apparatus of claim 1, further comprising:

a rack formed on an external surface of the moveable rail; and a deceleration member engaged with the rack to be rotated and configured to limit speed at which the moveable rail is drawn out.

16. The cooking apparatus of claim 15, wherein the deceleration member includes a fixed axis, a plurality of spokes that extends in a radial direction from an outer circumferential surface of the fixed axis, and a ring-shaped pinion configured to connect the plurality of spokes, and wherein the pinion is engaged with the rack to be rotated.

17. The cooking apparatus of claim 16, wherein an upper end and a lower end of the fixed axis are respectively fixed to an upper flange and a lower flange, which extend from the case, wherein the plurality of spokes are formed of a material having predetermined elastic force, and wherein at least a portion of the pinion penetrates the fixed rail and is engaged with the rack.

* * * * *